United States Patent [19]

Bowling et al.

[11] 4,324,367

[45] Apr. 13, 1982

[54] SAND LUMP CRUSHING DEVICE

[75] Inventors: Joseph E. Bowling, Waynesboro, Pa.; James H. Carpenter; Russell L. Rowe, both of Hagerstown, Md.

[73] Assignee: Kennecott Corporation, Stamford, Conn.

[21] Appl. No.: 90,028

[22] Filed: Oct. 31, 1979

[51] Int. Cl.[3] ..... B02C 19/12

[52] U.S. Cl. ..... 241/60; 164/5; 241/94; 241/152 A; 241/291; 241/DIG. 10

[58] Field of Search ..... 51/163.1; 241/152 A, 241/57, 60, 69, 79.1, 94, 273.2, 28 CR, 291, 285 A, 601, 285 B, 95, DIG. 10; 164/5, 412

[56] References Cited

U.S. PATENT DOCUMENTS

| | | | |
|---|---|---|---|
| 3,897,910 | 8/1975 | Deve | 241/DIG. 10 X |
| 4,025,419 | 5/1977 | Musschoot | 51/163.1 X |
| 4,226,375 | 10/1980 | Cameron | 241/285 B X |

FOREIGN PATENT DOCUMENTS

| | | | |
|---|---|---|---|
| 2751500 | 9/1978 | Fed. Rep. of Germany | 164/5 |
| 2808350 | 8/1979 | Fed. Rep. of Germany | 164/5 |
| 51-3690 | 2/1976 | Japan | 164/5 |

*Primary Examiner*—Mark Rosenbaum
*Attorney, Agent, or Firm*—Charles E. Brown

[57] ABSTRACT

This relates to a device for crushing sand lumps. The device includes a tub which is resiliently mounted and is provided with means for vibrating the same in a generally vertical direction parallel to a rear wall of the tub. The tub rear wall is hollow and is provided on the inner face with perforated crusher plates. Sand flow through the crusher plates is down through the hollow rear wall and there is an upwardly directed airwash for the falling sand. The lower portion of the rear wall is in the form of a door mounted for swinging movement about a horizontal axis. The door is operated by a cylinder having an axis parallel to the direction of vibration and the door is opened during the vibration of the tub so as to direct scrap and uncrushed lumps out through the lower portion of the rear wall in the same direction of salvaged sand flow. The crusher plates include a main wall having elongated slots forming the perforations and there are lugs projecting forwardly from the main wall above and below the slots with the vertical dimensions of the lugs and slots and the spacing thereof being in accordance with the amplitude of intended vibration to provide a maximum crushing effect.

15 Claims, 10 Drawing Figures

FIG.5
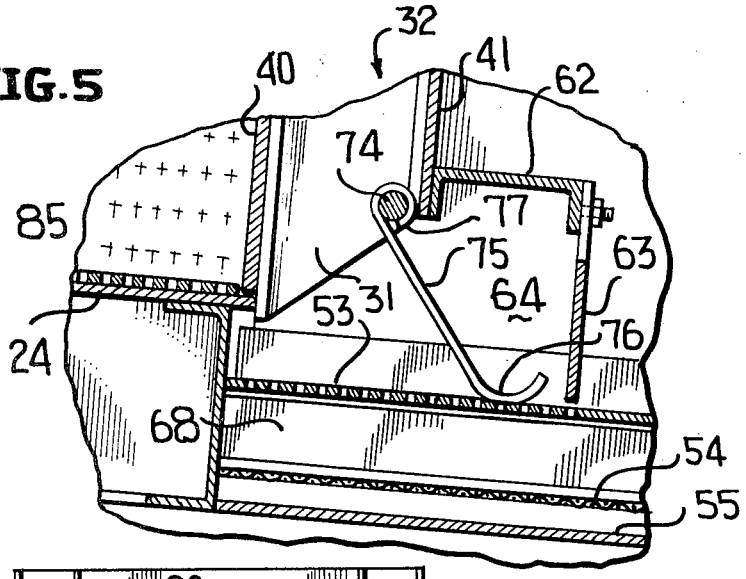
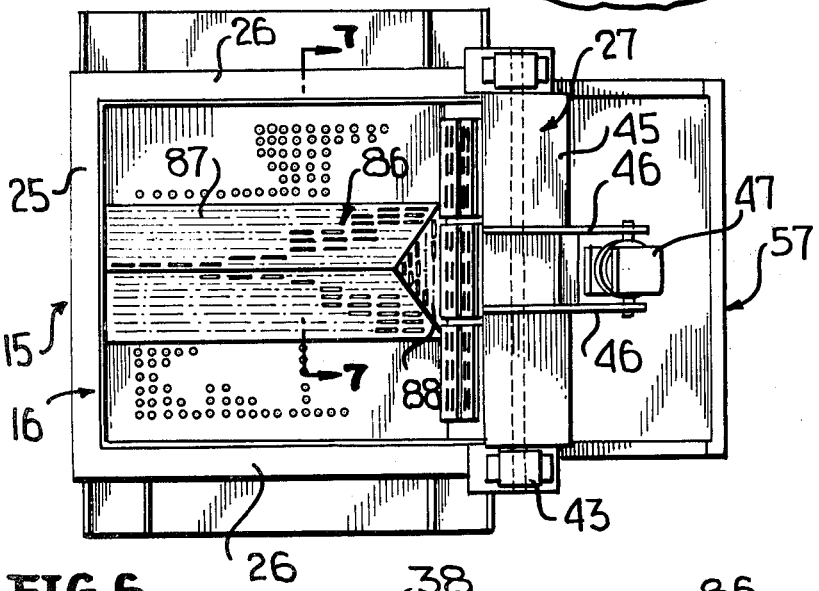
FIG.6
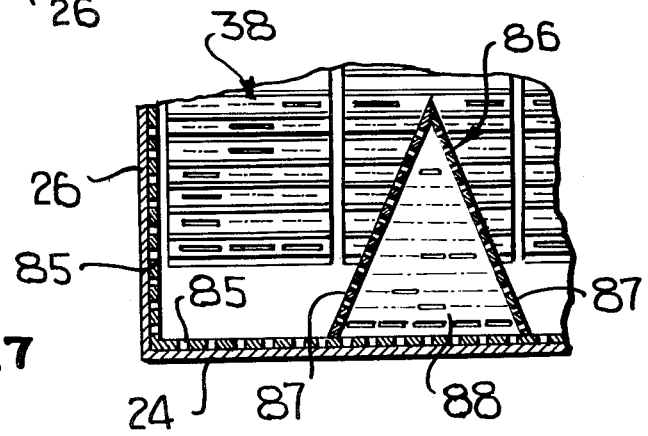
FIG.7

38
9
9
78
80
81
82
83
84
a
b
c
d
a'
b'
c'
d'

SAND LUMP CRUSHING DEVICE

This invention relates in general to new and useful improvements in crushing devices and more particularly to a device for crushing sand lumps.

In order to economically utilize chemically bonded, self-setting sand mixtures, it is necessary to reclaim the sand for re-use. There are also instances where it is desirable to reclaim green sand and thereby reduce overall sand cost.

Several methods are now available to reduce and lumps to granular sand and to recondition the sand. The sand lump crushing device of this invention is primarily concerned with the lump reduction process with this reduction of organics or clay in the sand being of secondary concern. While there are several methods of reducing sand lumps, the most efficient include a vibratory tub device.

The vibratory tub breaks down the lumps by attrition. In doing so, the surfaces of the device contacting the sand experience a high wear rate. Such devices are disclosed, for example, in U.S. Pat. Nos. 3,793,780 and 4,025,419 among others. Such devices are normally furnished with openings for the granular sand and small sand lumps to exit through. After an accumulation of unacceptable lumps in the tub, such as core rods, scrap casting, etc., the tub must be stopped. A discharge gate, located at the end opposite the small openings, is opened and a secondary drive system is started to discharge the unacceptable lumps. Also, a means to take away the unacceptable lumps must be provided under the discharge gate. This may be a permanently installed unit such as an oscillating conveyor or a portable scrap bin. If the bin or conveyor remains under the discharge chute at all times, then the means of loading the tub can be more complicated, especially if a front end loader is used. If the bin must be moved under the discharge gate for each discharge cycle, then production time is required to properly locate the bin and remove it.

Vibratory tubs normally have a secondary chamber. Granular sand and small lumps enter this chamber via the primary plate. Openings in the primary plate are normally in the range of $\frac{3}{8}''$ slots. The lumps will randomly vibrate in this chamber until they are reduced in size and fall through a second screen, or are vibrated out a scrap discharge opening in the side of the chamber. When excess lumps accumulate in the chamber they are manually removed through the scrap discharge opening. The second screen is normally a $\frac{1}{4}''$ perforated plate or the like.

The material that passes the second screen falls into a second chamber. Here the lumps will again randomly vibrate until they are reduced in size and pass through a third screen or are vibrated out a scrap discharge opening in the side of the chamber. When excess lumps accumulate in this chamber, they are manually removed through the scrap discharge openings. The third screen is normally of sufficient size so that only granular sand will pass.

It is accepted knowledge that the throughput rate of a vibrating tub is dependent on how full the tub is. The attrition rate is greatly increased when the tube is maintained at or near full. Due to the side discharge being at the screen level on the present vibrating tubs, an adequate head of sand cannot be retained in the chambers and therefore the chamber's efficiency as a lump reduction method is greatly reduced.

This invention relates to the provision of a tub or like container with straight or sloping sides. The bottom is normally square or rectangular with a longer side being a discharge side. The tub is mounted on springs and two or more eccentric devices make the tub vibrate up and down with a slight forward motion. The sand lumps and tramp metal are subjected to vibration and agitation until the sand passes through the crusher plate. Periodically, a door at the rear of the unit is opened to discharge accumulated tramp metal or other unacceptable lumps. Since the sand will always be flowing from front to back, the machine does not require stopping to discharge. Also, the same drive system is used for the lump breaking process and the scrap discharge process.

In accordance with this invention, the sand grains and lumps passing through the primary crusher plate fall down through an airwash curtain. This is effected by providing a passage rearwardly of the crusher plate throughwhich air is upwardly directed. The counter flow airwash cleans the sand of unacceptable fines in the sand. In order to prevent large re-usable grains from being removed, a plenum is provided at the upper end of the air passage.

In accordance with this invention, there is provided a novel crusher plate which has a relationship of abrading lugs and through-openings or slots which are correlated to the amplitude of vibration of the unit so as to provide for a maximum abrading of the sand lumps with there being a minimum extrusion of the sand lumps as a unit through these slots.

Another feature of the invention is the formation of the lower portion of the rear wall as a door which is pivotally mounted on a horizontal axis for swinging to an open position so that when there is an accumulation of trash and undesirable lumps, the rear door may be opened and the trash and excess lumps may be conveyed out through the resultant opening in the rear wall for a discharge into a separate collection bin from the sand collection unit.

Another feature of the invention is to provide an actuator for the door which is in the form of a fluid cylinder having an axis which is disposed parallel to the direction of vibration of the unit.

Yet another objective of this invention is to provide in a first chamber which receives granular sand and small sand lumps passing through the crusher plate, hammer means for further breaking down the small sand lumps.

Another feature of the invention is the provision of a novel screen arrangement wherein overflows or weirs are provided so that when overloading of individual chambers does occur, there will be an overflow which does not require the immediate stoppage of the apparatus and provides for a maximum production rate.

Still a further feature of the invention is the lining of the tub with perforated plates so as to abrade the sand lumps as they progress towards the rear wall for engagement with the crusher plate. If desired, the central portion of the tub may be provided with upstanding rib means or the like to provide a greater abrading action.

With the above, and other objects in view that will hereinafter appear, the nature of the invention will be more clearly understood by reference to the following detailed description, the appended claims and the several views illustrated in the accompanying drawings.

FIG. 5 is an enlarged fragmentary sectional view of the lower portion of the door and the screen assembly, including hammers for breaking the sand lumps.

FIG. 6 is a fragmentary top plan view of the device having incorporated therein a sand abrading rib.

FIG. 7 is a fragmentary transverse sectional view taken generally along the line 7—7 of FIG. 6 and shows further the details of the interior of the tub.

Figure 2:
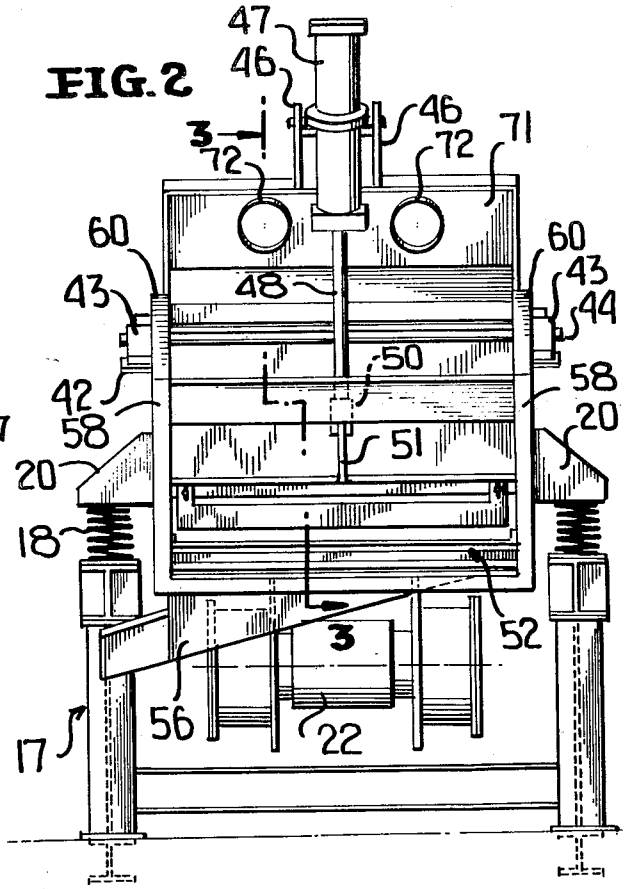
FIG. 2 is a rear elevational view of the device.
Figure 1:
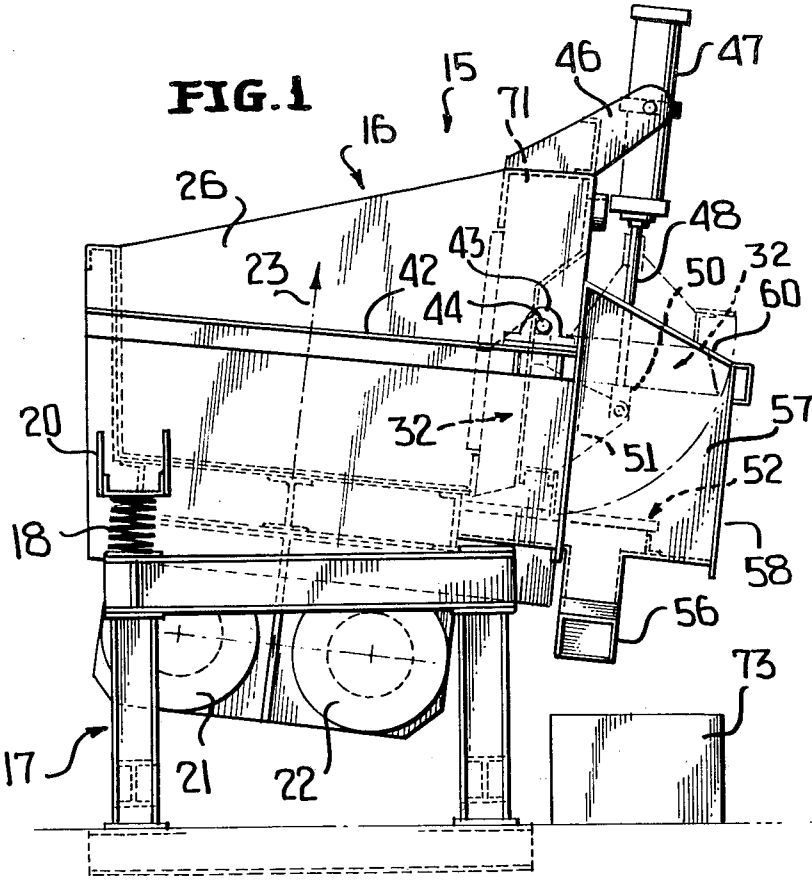
FIG. 1 is a side elevational view of the sand lump crushing device and shows the general construction thereof.

Referring now to the drawings in detail, it will be seen that there is illustrated in FIGS. 1 and 2 the overall details of the sand lump crushing device, the device being generally identified by the numeral 15. The device 15 includes a tub, generally identified by the numeral 16, which is the primary subject of this invention.

The tub 16 is mounted on a supporting platform 17 by means of four vertically disposed springs 18, two springs on each side of the tub. The tub 16 has extending from the opposite sides thereof support brackets 20.

In the illustrative form of the invention, the underside of the tube 16 carries a pair of rotary vibrators 21, 22 which are operative to vibrate the tub 16 in a generally vertical direction identified by the arrow 23.

Inasmuch as the foregoing features of the device 15 per se are known, no further description of these features is required here.

The tub 16 is generally rectangular in outline and includes a bottom wall assembly 24, a front wall assembly 25, two side wall assemblies 26 and a rear wall assembly 27. The principal features of the invention reside in the rear wall assembly 27 although the tub 16 does have other novel features.

The rear wall assembly 27 includes transversely spaced vertical supports 28. The supports 28 are divided into upper and lower portions 30, 31 with the upper portion 30 being fixedly mounted and the lower portion 31 being part of a hingedly mounted door generally identified by the numeral 32.

The upper support portions 30 have secured to the inner faces thereof an inner wall member 33. The lower part of the upper support portions 30 carry an outer wall member 34 which terminates in an upwardly and rearwardly sloping wall member 35 which, in turn, terminates in an upper outer wall member 36.

Below the inner wall member 33 is an upper perforated crusher plate, generally identified by the numeral 37. Actually there are a plurality of such crusher plates extending transversely between adjacent ones of the upper support member portions 30.

As described above, the lower support member portions 31 form part of a door. The upper inner surface of the door 32 is defined by a plurality of transversely extending perforated crusher plates 38 which may be identical to the crusher plates 37. If desired, below the crusher plates 38 will be a lower inner wall portion 40.

The outer part of the door 32 is formed by an outer wall portion 41.

Figure 3:
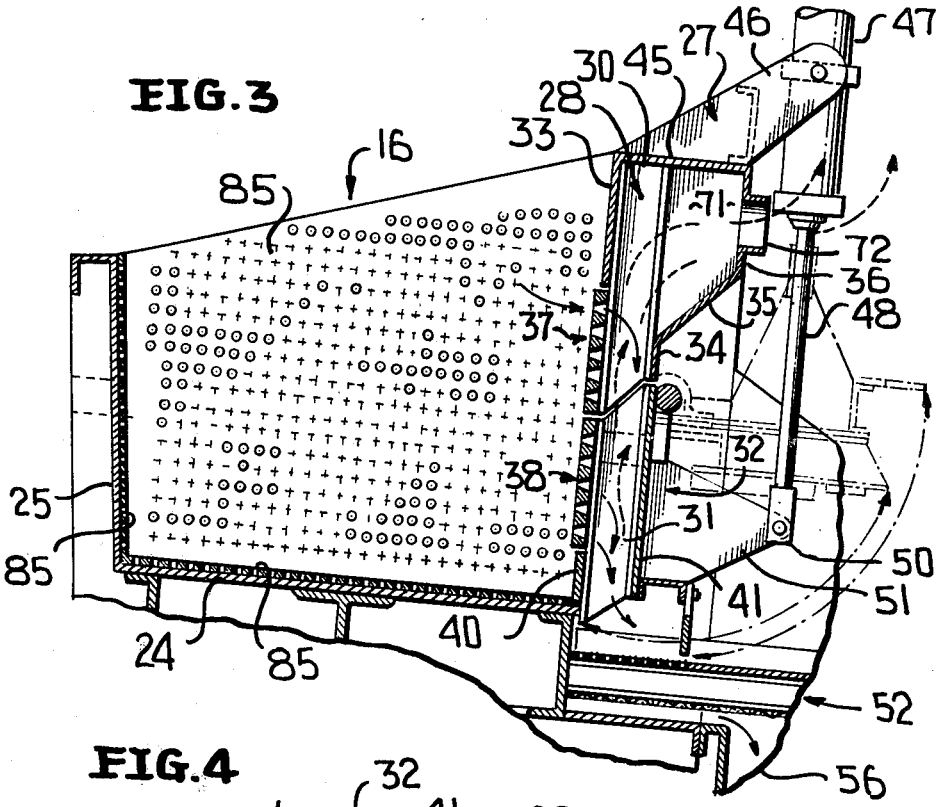
FIG. 3 is an enlarged fragmentary longitudinal sectional view taken generally along the line 3—3 of FIG. 2 and shows the internal construction of the device.

As will be readily apparent from FIG. 1, the side wall arrangements 26 extend rearwardly beyond the rear wall arrangement 28 and terminate generally coplanar with the outer wall member 36. The side wall arrangements 26 carry angle stiffening members 42 on the outer surfaces thereof and these members carry bearing blocks 43 which, in turn, carry a pivot shaft 44 for the gate 32, as is best shown in FIG. 3.

With reference to FIGS. 1 and 2, it will be seen that extending rearwardly and upwardly from the outer wall member 36 at a top wall member 45 of the rear wall arrangement 28 are a pair of mounting plates 46 which support a fluid cylinder 47. The fluid cylinder 47 has a piston rod 48 which is provided at its lower end with a fitting 50 that is hingedly connected to the door 32 by means of a bracket 51.

At this time it is pointed out that the axis of the cylinder 47 and the piston rod 48 is disposed substantially parallel to the direction of vibration travel of the tub 16, as identified by the arrow 23. By having the cylinder so positioned in the closed position of the door 32, no undue bending or twisting forces are involved.

It is to be understood that when the cylinder 47 is actuated, the door 32 will be pivotted to an open position so that scrap and other matter which will not pass through the crusher plates 37, 38 will be periodically discharged. This will be described in more detail hereinafter.

Referring now to FIGS. 3 and 5 in particular, it will be seen that disposed below the door 32 and below the level of the bottom wall arrangement 24 is a screen assembly, generally identified by the numeral 52. The screen assembly 52 includes an upper screen 53 which is disposed generally parallel to the bottom wall of the tub. Below the screen 53 is a smaller mesh screen 54. A discharge wall 55 is disposed in spaced relation below the screen 54. The screens 53 and 54, as well as the plate 55 slope slightly downwardly and to the rear. Thus sand and other matter falling onto the screens will travel generally to the right or to the rear. The plate 55 carries a discharge chute 56 into which granular sand, which is being salvaged, flows.

It is to be noted that disposed rearwardly of the lower portion of the rear wall arrangement 27 are spaced side walls 57. The side walls 57 are stiffened by turned flange portions 60. An extension of the plate 55, the extension being identified by the numeral 61, extends to the rear of side wall 57 and is rigidly secured thereto.

The lower part of the door 32 carries an inverted horizontally extended channel member 62 which has depending from the outer edge thereof a plate 63. The plate 63, in the closed position of the door 32 cooperates with the screen 53 to define a first compartment 64. It is to be noted that the plate 63 does not extend the full height of the compartment 64 and has an opened space 65 thereabove with the plate 63 functioning as a weir in a manner to be described hereinafter.

Figure 4:
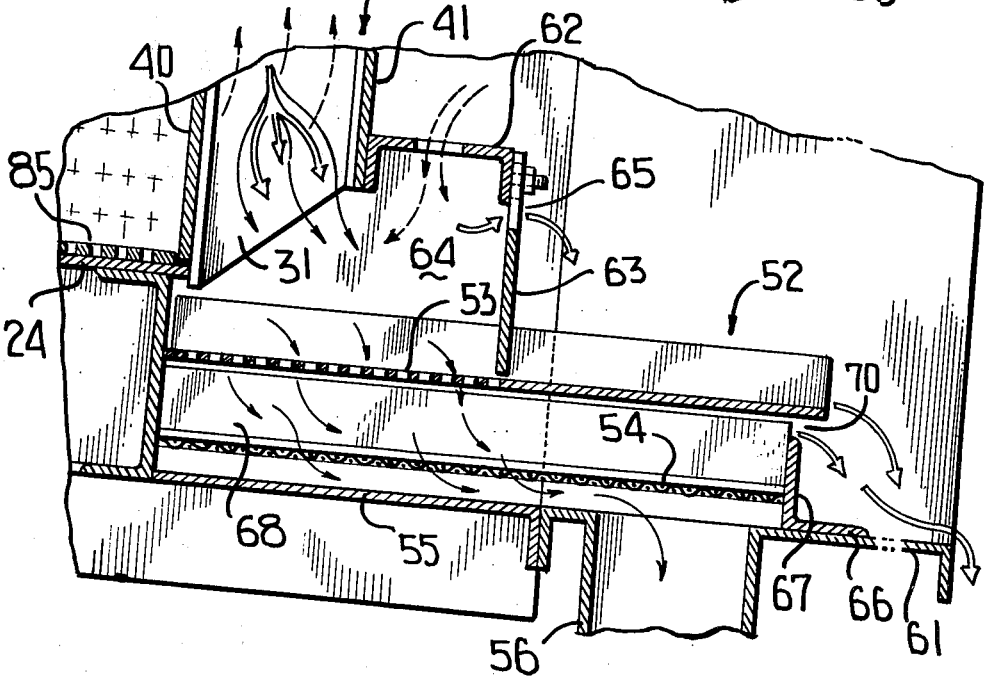
FIG. 4 is an enlarged fragmentary sectional view taken through the screen and door bottom.

It is also to be noted with reference to FIG. 4 that the plate portion 61 carries an angle member 66 having an upstanding flange 67 which closes off the right or rear end of a second chamber 68 disposed between the screens 53, 54. The flange 67 does not extend entirely to the screen 53 with there being a space 70 above the flange 67 and the flange 67 functioning as a weir in the manner to be described in detail hereinafter.

It is to be understood that the rear wall arrangement 27 is of a hollow construction and defines within the confines thereof an air passage. Inasmuch as the rear wall arrangement is of a greater width at the upper part thereof, this upper part defines an air plenum 71. The air plenum 71 has suitable rearwardly opening air discharge fittings 72. It is to be understood that air will be drawn up through the rear wall arrangement 27 in opposition to sand falling down through the passage within the interior of the rear wall arrangement 27 so that sand passing through the crusher plates 37, 38 will be washed by the upward flowing air and fines not suitable for salvaging will be discharged into a suitable dust collector (not shown).

The sand grains and lumps passing through the crusher plates or screens 37, 38 fall into the chamber 64 into overlying relation with respect to the screen 53. Lumps and foreign matter, such as scrap, not passing through the screen 53 will accumulate adjacent the rear wall 63 of the chamber and should there be sufficient build up, this material will flow over the rear wall 63 through the opening and be discharged in the rear part of the housing 57 down along side the chute 56 into a suitable receptacle 73.

Sand and small lumps passing through the screen 53 will fall into the chamber 68 onto the screen 54 which is of a mesh selected to control the salvaged granular sand. Granular sand passing through the screen 54 is collected in the chute 56 and delivered to a suitable receptacle (not shown).

It is to be understood that small sand lumps and small foreign matter may pass the screen 53 but will not pass the screen 54. As this material builds up at the right side of the chamber 68, it will eventually flow over the weir 67 through the opening 70 and will also be discharged in the rear part of the housing 57 to fall into the receptacle 73.

It is to be understood that when there is an undue accumulation of material which will either not pass the crusher plates 38 in the first place or the screen 53 in the second place, the door 32 is swung upwardly and rearwardly to an open position while the vibrators 21, 22 are still being operated. This will result in the large material collected in the bottom rear part of the tub 16 as well as the large material collected in the chamber 64 to be caused to travel rearwardly out through the rear part of the apparatus, over the rear part of the screen 53 and down through the housing 57 into the receptacle 73. After the large material has been cleared, the door 32 may then be closed and the operation continued in the normal manner.

At this time it is pointed out that in the event the flow through the crusher plates 37, 38 is not sufficiently large, the door 32 may be left partially opened to thus control the flow out of the tub. In a like manner, the inner wall member 40 could be of a shutter construction and selectively opened to permit additional flow out of the tub 16.

It is to be noted that small sand lumps which pass through the crusher plates 37, 38 into the chamber 64, but which will not pass the screen 53 may be broken up in a simple manner. With reference to FIG. 5, it will be seen that the door 32 may carry a transverse shaft 74 in the upper part of the chamber 64. The shaft 74 may have mounted thereon a plurality of small hammers 75 for pivotal movement. The hammers 75 have arcuate lower end portions 76 which may be considered heads. The heads 76 cooperate with the underlying screen 53 to effect the crushing of the small sand lumps which pass through the crusher plates 37 and 38. If desired, the shaft 74 may be provided with suitable stops 77 which limit the upward swinging of the hammers 75.

Figures 8, 9, 10:
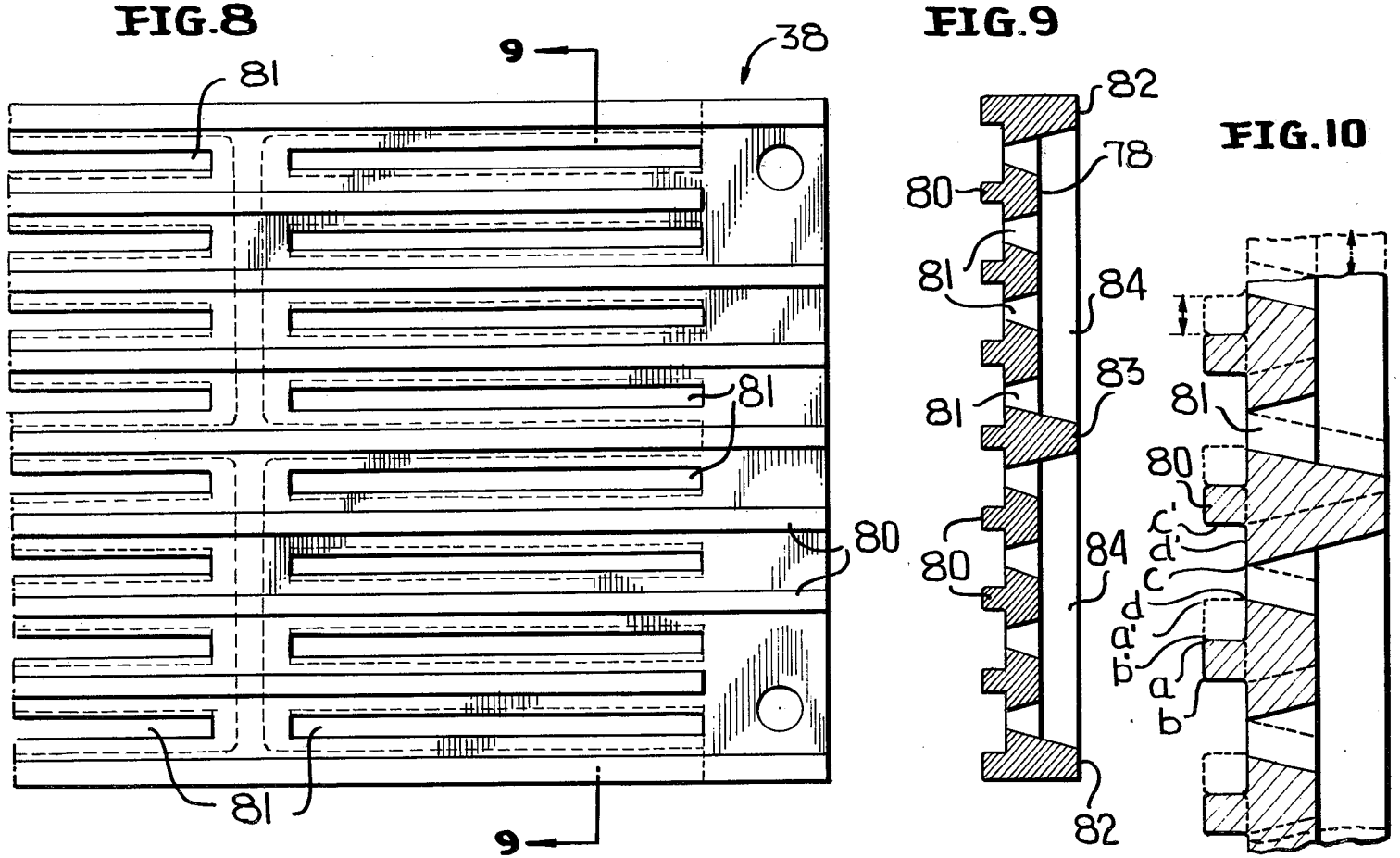
FIG. 8 is a fragmentary elevational view of the crusher plate.
FIG. 9 is a vertical sectional view taken generally along the line 9—9 of FIG. 8.
FIG. 10 is a fragmentary sectional view similar to FIG. 9 but showing the effect of movement of the crusher plate as effected by the vibrating of the device.

Reference is now made to FIGS. 8, 9 and 10 wherein the details of a typical one of the crusher plates is illustrated. The illustrated crusher plate is identified by the numeral 38 for reference purposes only.

With reference to FIG. 9, it will be seen that the crusher plate 38 includes a main plate portion 78 which has projecting forwardly therefrom transversely extending lugs 80. Between each vertically adjacent pair of lugs 80 there is a series of perforations or slots 81, as is best shown in FIG. 8. The slots 81 flare rearwardly so that they are of a greater width at the rear ends thereof than at the front ends thereof.

It is also to be noted that the crusher plate 38 is reinforced at the rear part of the main plate 78 by way of upper and lower reinforcing ribs 82 at a central reinforcing rib 83 which extends horizontally. There are also vertical reinforcing ribs 84. It is to be noted that the slots 81 are interrupted where the vertical reinforcing ribs 84 are disposed.

At this time it is also pointed out that in view of the flaring of the slots 81 and since the slots 81 are disposed immediately adjacent the ribs 82, 83, the surfaces of these ribs which are disposed adjacent the slots are tapered at the same angle.

The vertical dimensions of the lugs 80 and the slots 81 are proportioned in accordance with the amplitude of the vibration of the tub 16 and thus the crusher plates 37, 38. The crusher plate 38 will have the following dimensions when the amplitude of vibration is on the order of 5/16" or slightly greater. The lugs 80 will have a vertical dimension of 5/16". The front opening of each slot 81 will have a vertical dimension of 5/16" while the rear opening dimension will be on the order of $\frac{1}{2}$". The spacing between vertically adjacent lugs will be $\frac{7}{8}$" with the result that each slot 81 is spaced from a vertically adjacent lug 80 a dimension slightly less than 5/16".

With particular reference to FIG. 10, 11 it will be seen that the upper corner of a lug 80 is defined by the letter a while the lower corner is defined by the letter b. In a like manner, the upper edge of the front opening of the slot 81 is identified by the letter c while the lower edge is identified by the letter d.

When the crusher plate is vibrated a vertical distance of 5/16", a sand lump in contact with the plate will be wiped by the edges a, b, c and d. It will be seen that the edges or corners will move so that a moves to a', b moves to b', c moves to c', and d moves to d'. It will be seen that by the proper dimensioning of the lugs and the slots, the entire surface of an opposing sand lump will be wiped during the vibration of the crusher screen.

It has been found that if the slot is wider than the amplitude of vibration of the crusher screen, the sand lump extrudes through the slots 81 and is either lost as scrap, or if ground in a second chamber (not shown), is not ground as efficiently as it would be if it remained in the tub.

Although the primary abrasive action by the walls on the sand lumps is along the inner face of the rear wall of the tub 16, it is to be understood that other abrading action may take place within the tub 16. To this end, at least the bottom wall 24 and the side walls 26 of the tub 16 are lined with perforated plates 85 and sand particles abraded thereby flow towards the rear of the tub 16. If desired, a similar perforated plate 85 may be used to line the front wall 25.

Referring now to FIGS. 6 and 7, it will be seen that additional abrading action may be effected in the tub while providing the tub with an upstanding wedge like arrangement, generally identified by the numeral 86. The wedge like arrangement 86 may include a pair of upwardly sloping plates 87, which may be perforated, arranged in a triangular formation, as is generally illustrated in FIG. 7. The plates 87 may be joined at their rear ends by an upwardly and forwardly sloping plate 88, which may be perforated like plates 87. Not only do the plates 87 function to abrade the sand lumps engaging the same, but they also increase pressure between the sand lumps located between the wedge like arrangement 86 and the side walls 26, as well as the pressure between the lumps and the wedge like arrangement 86 and the side walls 26.

It is to be understood that the space within the plates 87 and 88 is opened to the rear of the tub for the discharge of the abraded sand whenever perforations are used in these plates.

From the foregoing description of the invention, it will be seen that the device will be effective to discharge the undesired lumps out of the same end as the good sand, thereby providing for a more efficient sand system re-out. Obstacles, such as scrap ends, are not in the path of the in feed loader or conveyor which loads the tub from the top.

The crusher plate, which is formed of suitable hardened metal, in cast, thereby providing for an economical design. The design of the crusher plate is such that the sand particles will freely flow through the slots 81 and not bind therein. Further, the crusher plate is of a configuration such that as wear occurs, the cutting edges are retained throughout the life of the plate.

A continuation application under the provisions of 37 CFR 1.60 and directed to the subject matter of claims 16–35 of the originally filed application was placed on file in the U.S. Patent and Trademark Office on Oct. 2, 1981, and assigned Ser. No. 308,092.

Although only a preferred embodiment of the sand lump crusher has been specifically illustrated and described herein, it is to be understood that minor variations may be made therein without departing from the spirit and scope of the invention as defined by the appended claims.

We claim:

1. In a sand lump crusher an active end wall arrangement comprising inner and outer walls disposed in spaced relation and defining a vertical inner passage of restricted width, a perforated crusher plate forming a lower part of said inner wall and directing crushed sand into said inner passage for free downward flowing movement, and means for directing an air wash upwardly generally through the entire cross section of said inner passage counter to flow of crushed sand and removing undesired fines from downward flowing crushed sand.

2. The end wall arrangement of claim 1 wherein said inner passage has an enlarged upper portion defining a plenum for reducing air velocity for permitting particles of a preselected size to be returned down said inner passage.

3. The end wall arrangement of claim 1 wherein the lower part of said end wall including at least part of said crusher plate is in the form of a door for facilitating the discharge of scrap, uncrushable lumps and the like.

4. The end wall arrangement of claim 3 wherein a lower portion of said crusher plate is part of said door and an upper portion of said crusher plate forms a part of a stationary portion of said inner wall.

5. The end wall arrangement of claim 3 wherein said door includes portions of both said inner wall and said outer wall.

6. The end wall arrangement of claim 3 wherein said door includes portions of both said inner wall and said outer wall and is mounted for swinging movement about a generally horizontal axis.

7. The end wall arrangement of claim 6 wherein there is a fluid cylinder actuator for opening and closing said door, said lump crusher having vibratory means for vibrating said end wall arrangement in a primary upward and rearward direction, and said actuator in a closed position of said door having an axis substantially parallel to said direction.

8. The end wall arrangement of claim 1 wherein said inner passage terminates at its lower end in a chamber overlying a screen and having a baffle type outlet for separating scrap and sand clumps passing through said perforated crusher plate.

9. The end wall arrangement of claim 8 wherein the lower part of said end wall is in the form of a door for facilitating the discharge of scrap, uncrushable lumps and the like, and said chamber being defined by a lower portion of said door.

10. The end wall arrangement of claim 8 wherein there are hammer means in said chamber for crushing sand lumps therein.

11. The end wall arrangement of claim 1 wherein said perforated crusher plate includes a main plate portion having horizontally extending vertically spaced perforations in the form of slots, and horizontally extending and vertically spaced lugs projecting forwardly from said main plate portion, said lugs defining abrading areas in front of said slots for constantly wiping sand lumps in advance of said main plate portion to prevent extrusion of sand clumps through said slots.

12. The end wall arrangement of claim 11 wherein said lugs and said slots are substantially of the same vertical dimension.

13. The end wall arrangement of claim 12 together with vibratory means for vibrating said end wall arrangement in a generally vertical direction having a movement component parallel to the plane of said main plate portion at least substantially equal to said slot and lug dimension.

14. The end wall arrangement of claim 12 wherein each slot is spaced from an adjacent lug a distance substantially no greater than said dimension.

15. The end wall arrangement of claim 12 wherein said lugs project from main plate portion a distance substantially equal to said dimension.

* * * * *